US005537723A

United States Patent [19]

Yoshida et al.

[11] Patent Number: 5,537,723

[45] Date of Patent: Jul. 23, 1996

[54] MOLDED SURFACE FASTENER

[75] Inventors: Hiroshi Yoshida, Toyama-ken; Shigeo Suzuki, Tokyo; Hissai Nishiyama, Toyama-ken, all of Japan

[73] Assignee: YKK Corporation, Tokyo, Japan

[21] Appl. No.: 298,172

[22] Filed: Aug. 30, 1994

[30] Foreign Application Priority Data

Sep. 8, 1993 [JP] Japan ..... 5-223557

[51] Int. Cl.[6] ..... A44B 18/00

[52] U.S. Cl. ..... 24/452; 24/442; 264/210.2; 264/290.2

[58] Field of Search ..... 24/306, 442–444, 24/446, 447, 575–577; 264/210.2, 210.7, 270.2

[56] References Cited

U.S. PATENT DOCUMENTS

| | | | |
|---|---|---|---|
| 4,077,410 | 3/1978 | Butterworth et al. | 128/287 |
| 4,522,853 | 6/1985 | Szonn et al. | 428/40 |
| 4,894,060 | 1/1990 | Nestegard | 24/442 X |
| 5,116,563 | 5/1992 | Thomas et al. | 24/442 X |
| 5,131,119 | 7/1992 | Murasaki et al. | 24/442 X |
| 5,180,534 | 1/1993 | Thomas et al. | 264/145 |
| 5,217,403 | 6/1993 | Nobbs | 450/155 |
| 5,230,851 | 7/1993 | Thomas | 24/442 X |
| 5,318,741 | 6/1994 | Thomas | 264/519 |
| 5,339,499 | 8/1994 | Kennedy et al. | 24/442 X |
| 5,361,462 | 11/1994 | Murasaki | 24/452 |

*Primary Examiner*—Peter M. Cuomo
*Assistant Examiner*—Robert J. Sandy
*Attorney, Agent, or Firm*—Hill, Steadman & Simpson

[57] ABSTRACT

A surface fastener-molded of synthetic resin, comprises: a plate-like substrate; and a multiplicity of hooks formed on one surface of the substrate integrally, each of the hooks being composed of a rising portion having a front surface rising from the substrate, a rear surface rising obliquely from the substrate along a smooth curved line and a reinforcing rib located on at least one side surface, and a hook-shape engaging portion extending forwardly from a distal end of the rising portion. After the molding, the plate-like substrate is biaxially stretched to have a smaller thickness and, at the same time, to increase the toughness in substantially all directions of the substrate.

2 Claims, 3 Drawing Sheets

MOLDED SURFACE FASTENER

BACKGROUND OF THE INVENTION

1. Field of the Invention

This invention relates to a surface fastener in which a plate-like substrate and a multiplicity of hooks are continuously and integrally molded by extrusion, and more particularly to a molded surface fastener in which the plate-like substrate is thin and flexible and has adequate toughness in all directions.

2. Description of the Related Art

A hooked surface fastener has been known long since in which hooks are formed by cutting loops of monofilaments woven into a woven cloth. With this type of surface fastener, softness of the woven cloth and softness of the monofilaments combine to make a very smooth touch when the hooks come into and out of engagement with loops of the companion fastener member. Additionally, since the monofilaments forming hooks are treated with drawing process, they are excellent in toughness against pulling and bending though small in cross-sectional area. Further, since the hooks can be formed in high density depending on the structure of the woven cloth, this type of surface fastener has a high engaging rate and hence can survive in repeated use. However, with this woven-cloth-type surface fastener, partly since the quantity of material is large and partly since a large number of process steps are required, it is difficult to reduce the cost of production.

To this end, an alternative molded surface fastener has been developed in which the substrate and the hooks are simultaneously and integrally molded by extrusion. The molding technology for this kind of surface fastener is disclosed in, for example, Japanese Patent Publication No. SHO 48-22768, Japanese Patent Publication No. SHO 52-37414, U.S. Pat. No. 3,312,583, and International Patent Japanese Publication No. HEI 1-501775.

According to the technology disclosed in Japanese Patent Publications Nos. SHO 48-22768 and SHO 52-37414, the substrate and the hooks can be molded integrally and continuously by extrusion. This molding method comprises steps of arranging a large number of mold discs and a large number of spacer plates alternately one over another to form a laminate drum, extruding a thermoplastic resin in a molten form onto the peripheral surface of the drum in rotation to force the resin into hook-forming cavities of the mold discs, compressing the resin painted over the drum surface to form a substrate, cooling the substrate and hooks, retracting the spacer plates radially inwardly, and peeling a completed belt-like surface fastener continuously from the drum surface. Each of the mold discs has in one side surface a multiplicity of hook-forming cavities spaced circumferentially at regular distances and extending from the circumferential surface toward the center. Opposite side surfaces of each of the spacer plates are smooth and flat.

Regarding the molding technologies disclosed in the U.S. Pat. No. 3,312,583 and International Patent Japanese Publication No. HEI 1-501775, though the two technologies are different from each other in means for forcing the resin into the hook-forming cavities, hooks, which have been molded in the cavities integrally with the substrate, are removed from the drum surface together with the substrate in timed relation with rotation of the drum while the spacer plates are fixed. These molding technologies are simple in structure and process, as compared to the molding technology of Japanese Patent Publication No. SHO 48-22768.

The reason why the spacer plates must be used in the prior art is that the whole contour of the individual hooks could not have been made in a single mold. Further, partly since the cavities to be provided in the mold disc must be such that distal ends of hooks must be oriented in the circumferential direction of the disc, and partly since the shape of side surface of the rising portion must be simple, the individual hooks tend to fall flat from their base as they are slender. Because of such restriction of structure, the books must be oriented in a common circumferential direction so that it would be difficult to secure necessary engaging forces in all directions. Further, since after repeated use the hooks would fall flat and would not restore their original standing posture, their engaging rate with loops of the companion fastener memeber would lower so that the continuation of the engaging forces could not be expected. Under these circumstances, the present inventors proposed to form a reinforcing rib on at least one side surface of the rising portion of the individual hook in order to prevent the hook from falling flat and also to make the orientation of the hooks opposite between adjacent rows in order to distribute plural engagement directions of the hooks (Japanese Utility Model Laid-Open Publication No. HEI 4-31512).

However, with the engaging members of the prior art surface fastener in which the substrate and the hooks are molded integrally, because of technological difficulty in making a mold, it is impossible to obtain a delicate shape as the woven cloth type, and the degree of toughness of the hooks and the substrate are too low if the hooks have the same size as that of monofilaments, thus making the surface fastener not suitable for practical use. Consequently, the size of the individual hooks must be increased in order to secure a desired degree of toughness. Further, the reinforcing ribs are provided so that the surface fastener becomes rigid.

If the hooks are rigid, the substrate for pulling off the hooks from the cavities after molding must have the same toughness. Therefore, it is inevitable to increase the thickness of the substrate to match with the toughness of the hooks during molding so that the whole surface fastener would become much more rigid, thus making the surface fastener difficult to be used with an article that needs adequate flexibility.

SUMMARY OF THE INVENTION

It is therefore an object of this invention to provide a molded surface fastener which has the same flexibility as the woven-type surface fastener and can secure a high engaging rate in which a substrate is prevented from being torn when it is sewn to an article and in which the substrate is thin and has adequate toughness and proofness against repeated use.

In order to accomplish the above-mentioned object, according to this invention, there is provided a surface fastener molded of synthetic resin which comprises a plate-like substrate and a multiplicity of hooks formed on one surface of the substrate integrally, each of the hooks being composed of a rising portion having a front surface rising from the substrate, a rear surface rising obliquely from the substrate along a smooth curved line and a reinforcing rib located on at least one side surface, and a hook-shape engaging portion extending forwardly from a distal end of the rising portion. The plate-like substrate is biaxially stretched after being molded.

In order to secure adequate toughness in all directions of the plate-like substrate, the multiplicity of hooks are arranged on the one surface of the plate-like substrate in rows and columns in such a manner that those of either each row or column are staggered from those of adjacent rows or columns by ½ pitch, and the plate-like substrate is biaxially stretched after being molded.

In operation, in the molded surface fastener of this invention, partly since the substrate is thin, compared to the thickness of the individual hook, to improve the flexibility, and partly since the substrate is biaxially stretched to give biaxial orientation to molecules and crystals of the substrate, the substrate has an increased degree of toughness compared to the prior art substrate. Further, since the individual hook has a reinforcing rib, it will hardly be deformed during stretching and its function will not be deteriorated.

Further, in the presence of the reinforcing ribs, it is possible to prevent the hooks from falling flat as well as to reduce the thickness of the individual hooks, thus increasing the flexibility of the hooks. With this surface fastener, partly since the substrate is made thinner and tougher by stretching and partly since the individual hooks can be made slenderer within the limit of engaging toughness, it is possible to secure adequate toughness as well as to give an adequate degree of flexibility and a delicate touch to the surface fastener.

Furthermore, if the hooks of either each row or column are staggered from those of adjacent rows or columns by ½ pitch, namely, if they are arranged in a staggering pattern, the substrate can be stretched uniformly in either row or column direction throughout the entire area except the hook areas so that the toughness against tearing can be distributed substantially uniformly over the whole substrate.

DETAILED DESCRIPTION

An embodiment of this invention will now be described in detail with reference to the accompanying drawings.

Figure 1:
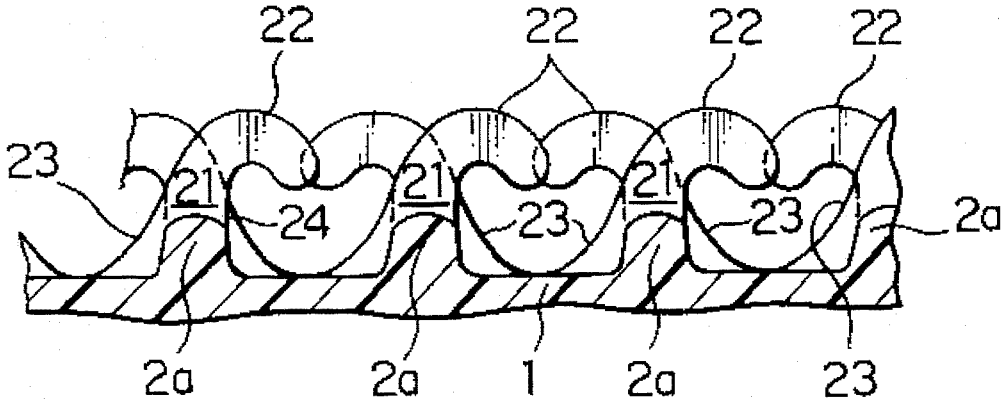
FIG. 1 is a fragmentary side view, showing a hook structure of a molded surface fastener partly in cross section according to a typical embodiment of this invention.
Figure 2:
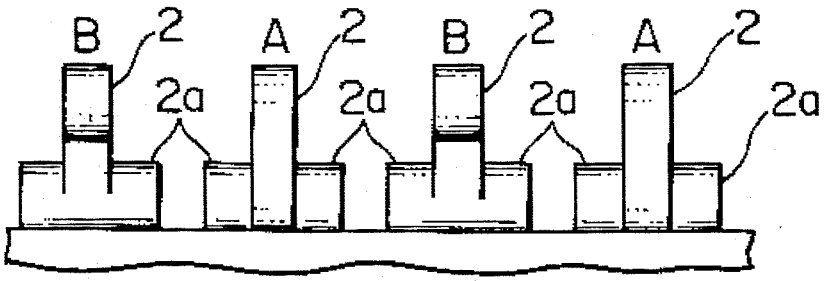
FIG. 2 is a fragmentary front view of the fastener.

FIG. 1 is a fragmentary side view showing a typical hook structure of a surface fastener according to this invention, and FIG. 2 is a fragmentary front view of the surface fastener. In FIGS. 1 and 2, reference numeral 1 designates a plate-like substrate, on the upper surface of which a multiplicity of hooks 2 are arranged in rows and columns. In the illustrated example, two rows A, B of hooks 2 are shown, and the hooks 2 of each row A, B are different in orientation by 180° from those of each others's row B, A.

The substrate 1 and the hooks 2 are integrally molded of thermoplastic resin by extrusion molding. As is apparent from the illustrated example, the thickness of the substrate 1 is small compared to the thickness or size of the individual hooks 2. Generally, during the molding, if the thickness of the substrate 1 is set to be a small value compared to the size of the hooks 2, the substrate 1 will be broken or locally deformed when the hooks 2 are removed from the mold.

Figure 3:
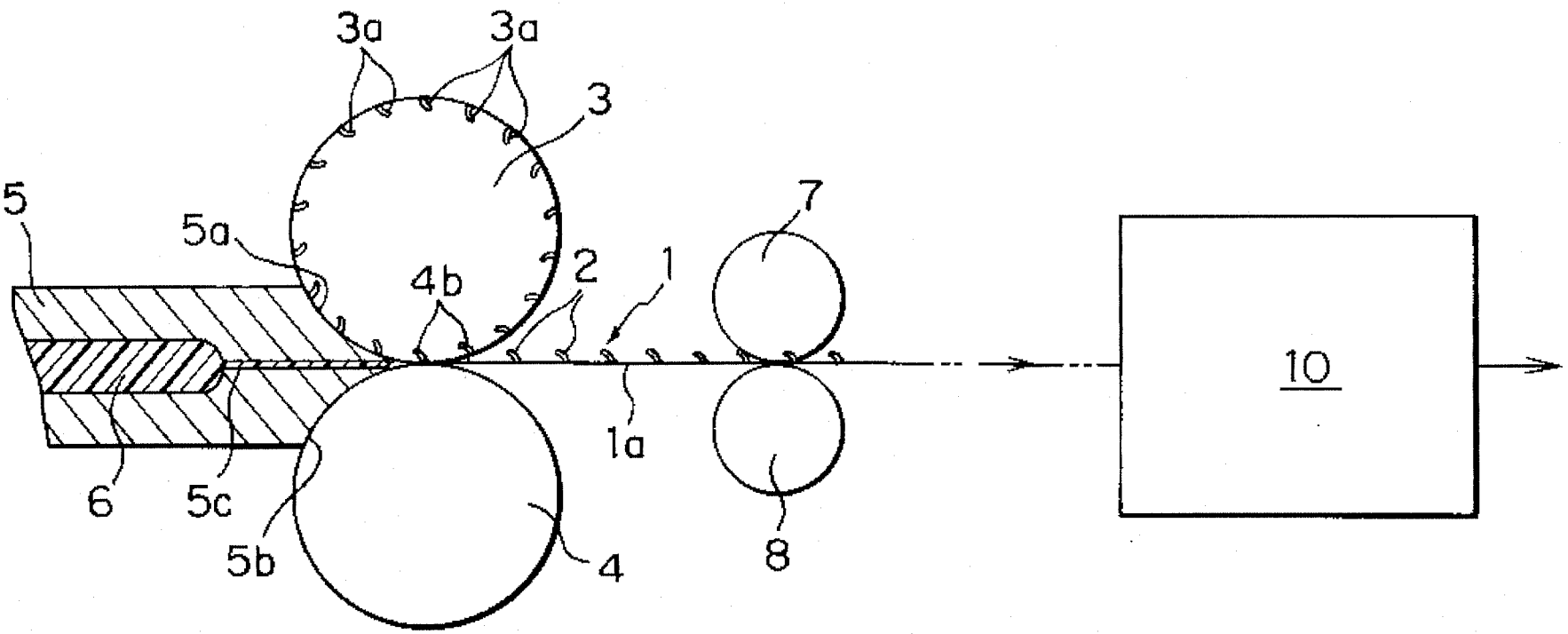
FIG. 3 is a side cross-sectional view showing an example of process of manufacturing the surface fastener according to this invention.

In producing this substrate structure, as shown in FIG. 3, a method similar to the conventional is used until the hooks 2 are removed from a die wheel 3, whereupon the substrate 1 is continuously treated with a biaxially stretching process.

In FIG. 3, since the structure of the die wheel 3 is substantially identical with the structure disclosed in International Patent Japanese Publication No. HEI 1-501775, it will now be described only simply. The die wheel 3 is in the form of a hollow drum in which a water cooling jacket is mounted. In the central portion of the drum, a multiplicity of ring plates are fixed in laminate. Every other ring plates have in opposite side surfaces a large number of hook-forming cavities *3a* with the base of each cavity opening to the peripheral surface of the cabitied ring plate. Opposite side surfaces of each ring plate adjacent to the cavities ring plate are smooth and flat. Though not shown in FIG. 3, the hook-forming cavities *3a* have reinforcing-rib-forming cavities.

The die wheel 3 is rotated in the direction of an arrow by a non-illustrated known synchronous drive unit. Under the die wheel 3, a pressure wheel 4 having an outside diameter substantially equal to that of the die wheel 3 is situated. The two wheels 3, 4 are driven synchronously in opposite directions and are situated close to upper and lower arcuate surfaces *5a*, *5b* of the tip of an extrusion nozzle 5. A quantity of molten resin 6 in a sheet form is extruded into a wedge-shape gap between the die wheel 3 and the pressure wheel 4 from the extrusion nozzle 5 via a sprue *5c*, and the molten resin 6 is compressed between the die wheel 3 and the pressure wheel 4, whereupon the molded surface fastener is positively drawn by a vertical pair of feed rollers 7, 8.

The resin material and the material for backing are exemplified by a thermoplastic resin such as nylon, polyester or polypropylene, and the same material or different materials may be used for the resin material and the backing. In molding, molten resin tempreture, extrusion pressure, die wheel temperature, rotational rate, etc. may be adjusted according to the material to be used.

With this surface fastener molding machine, the molten resin 6 extruded from the extrusion nozzle 5 is forced into the wedge-shape gap defined between the rotating die and pressure wheels 3, 4; a part of the molten resin 6 is charged gradually in the hook-forming cavities *3a* to form hooks 2 and, at the same time, is continuously compressed between the two wheels 3, 4 to form a plate-like substrate 1 having a predetermined thickness and a predetermined width.

The molten resin 6 compressed between the die wheel 3 and the pressure wheel 4 is cooled from inside of the die wheel 3 to gradually bocome solidified. When the substrate *1a* is drawn under a suitable tension in the discharge direction by the upper and lower feed rollers 7, 8 during the solidification, the individual hooks 2 are removed from the hook-forming cavities *3a* as they are elastically deformed straight, whereupon they will immediately restore their original contour and will become solidified in that shape.

Although the peripheral surfaces of the feed rollers 7, 8 may be smooth, it is preferable that grooves for receiving and guiding the hooks 2 should be provided in the peripheral roller surface where rows of hooks 2 pass so that the hooks 2 are prevented from being damaged. Further, the rotational rate of the feed rollers 7, 8 is set to be slightly higher than that of the die wheel 3 so that the hooks 2 can be removed from the hook-forming cavities *3a* smoothly.

In the illustrated embodiment, downstream of the feed rollers 7, 8, a biaxially stretching unit 10 is situated via a non-illustrated heating device. The biaxially stretching unit 10 is substantially identical in structure with the known biaxially stretching unit, so both of known biaxillay stretching mechanisms of the simultaneous and the successive type may be used.

Therefore, the surface fastener molded on the die wheel 3 passes the feed rollers 7, 8 and is then heated at a temperature between the softening point and the melting point by a non-illustrated heating device such as a hot air blower or an infrared ray irradiator, whereupon the resulting surface fastener is transferred to the biaxially stretching unit 10. In the biaxially stretching unit 10, the opposite side edges of the surface fastener are pulled transversely in opposite directions and longitudunally in the downstream direction while being clamped, and the shape of the surface fastener is solidified by a subsequent non-illustrated solidifying device, whereupon the surface fastener will be received in a receiving section after their opposite side edges are cut off by a non-illustrated side edge cutting device.

In the molded surface fastener of this invention, partly since the substrate 1 is thin compared to the thickness of the individual hook 2 to improve the flexibility, as shown in FIGS. 1 and 2, and partly since the substrate 1 is biaxially stretched to give biaxial orientation to molecules and crystals of the substrate 1, the substrate 1 has an increased degree of toughness compared to the prior art substrate. Further, since the individual hook 2 has reinforcing ribs 2*a*, it will hardly be deformed during stretching and its function will not be deteriorated.

The hook structure of this embodiment is similar to a wave crest as seen from the side in FIGS. 1 and 2 and is composed of a rising portion 21 rising from the substrate 1 and a hook-shape engaging portion 22 extending extending downwardly from the upper end of the rising portion 21. The rising portion 21 has a rear surface 23, i.e. a surface opposite to the hook-shape engaging portion 22, rising obliquely in a smooth curve from the surface of the substrate 1, and a front surface 24, i.e. a surface toward the hook-shape engaging portion 22, rising substantially perpendicularly from the surface of the substrate 1 via a round corner; as a result, the general shape of the rising portion 21 is such that its thickness increases progressively downwardly toward the substrate 1 as seen from the side. On the side surfaces of the rising portion 21, reinforcing ribs 2*a* are molded integrally of the substrate 1.

The reinforcing ribs 2*a* may have a desired shape. In the presence of the reinforcing ribs 2*a*, it is possible to prevent the hooks 2 from falling flat as well as to reduce the thickness of the individual hooks 2, thus increasing the flexibility of the hooks 2. With this surface fastener, partly since the substrate 1 is made thinner and tougher by stretching and partly since the individual hooks 2 can be made slenderer within the limit of engaging toughness, it is possible to secure adequate toughness as well as to give an adequate degree of flexibility and a delicate touch to the surface fastener.

Figure 4B:
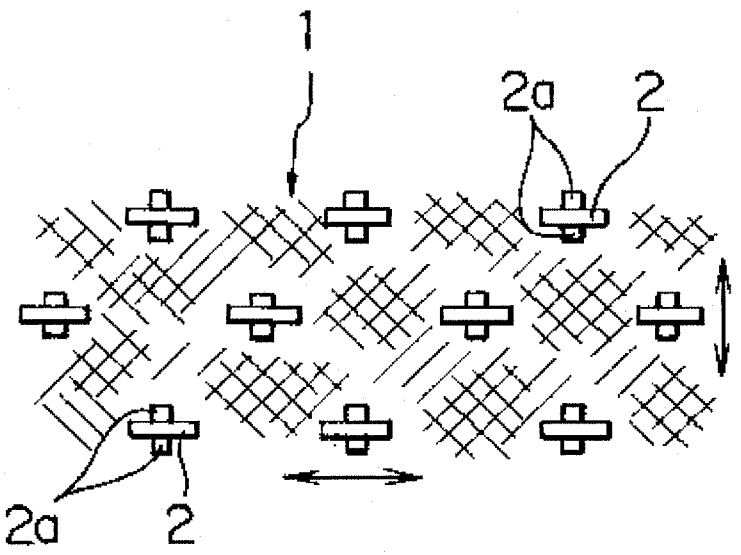
FIG. 4(A) and FIG. 4(B) show the difference in distribution of biaxially stretched areas between differenet arrangements of hooks on a substrate when a biaxially stretching process is preformed.
Figure 4A:
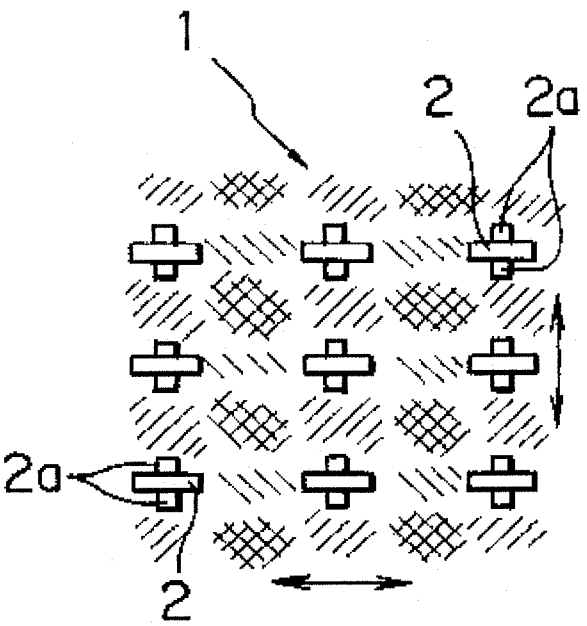

The hooks 2 may be arranged one at each of crossing point of a checkerboard pattern (hereinafter called "checkerboard arrangement") as shown in FIG. 4(A), and may be arranged also in such a pattern that the hooks 2 of either each row or column are staggered by ½ pitch from those of adjacent rows or columns (hereinafter called "staggered arrangement") as shown in FIG. 4(B).

In the surface fastener of FIG. 4(A), in which the hooks 2 have been molded in the checkerboard arrangement and the substrate 1 has been biaxially stretched in both the row and column directions, the substrate 1 at areas indicated by diagonal lines between the hooks 2 in each row or column is chiefly only uniaxially stretched respectively in the row or column direction, while the substrate 1 at areas indicated by cross diagonal lines centrally among four adjacent hooks 2 arranged in a square is biaxially stretched in both the row and column directions. Accordingly, in the surface fastener of FIG. 4(A), the substrate 1 has different thicknesses and tends to be torn locally in, for example, a subsequent sewing station.

Whereas, in the surface fastener of FIG. 4(B), in which the hooks 2 have been molded in the staggered arrangement, the substrate 1 at all areas, except about the hooks, which are indicated by crossed diagonal lines is biaxially stretched in both the row and column directions. Accordingly, in the surface fastener of FIG. 4(B), it is possible to secure adequate toughness in all directions in any area of the substrate 1 and to secure a uniform thickness substantially through the entire area of the substrate 1, thus keeping the substrate 1 from any risk of being torn in a subsequent sewing station.

The molded surface fastener should by no means be limited to the illustrated example, and the molding method for the molded surface fastener also should not be limited to the illustrated example.

As is apparent from the foregoing detailed description, with the molded surface fastener of this invention, partly since the substrate 1 can have a small thickness as compared to that of the hooks 2, and partly since the hooks 2 have reinforcing ribs 2*a*, it is possible to reduce the thickness of the hooks 2 within a limit of engaging strength so that the whole surface fastener can be very much flexible. Since the thickness of the substrate 1 is reduced after the molded hooks 2 have been removed from the mold cavities, the thickness of the substrate 1 can be set to a greater value as compared to the thickness after stretching so that the substrate 1 is kept from being damaged during the removing. Further, since the substrate 1 is stretched biaxially after the removing, it is possible to increase the toughness of the resulting substrate 1 in all directions.

Furthermore, if the hooks 2 are arranged in the staggered arrangement, the substrate 1 is free of chiefly only uniaxially stretched areas and is hence simultaneously biaxially stretched in both the row and column directions through the substantially entire area, thus eliminating any local difference in thickness of the substrate 1 so that adequate toughness can be secured in all directions of the substrate 1.

What is claimed is:

1. A surface fastener molded of synthetic resin, comprising:

(a) a plate-like substrate; and (b) a multiplicity of hooks formed on one surface of said substrate integrally, each of said hooks being composed of a rising portion having a front surface rising from said substrate, a rear surface rising obliquely from said substrate along a smooth curved line and a reinforcing rib located on at least one side surface, and a hook-shape engaging portion extending forwardly from a distal end of said rising portion;

(c) said plate-like substrate being biaxially stretched after being molded to give biaxial orientation to a molecular structure of the substrate.

2. A molded surface fastener according to claim 1, wherein said multiplicity of hooks are arranged on said one surface of said plate-like substrate in rows and columns in such a manner that said hooks of either each row or column are staggered from those of adjacent rows or columns by ½ pitch.

* * * * *